US006047538A

United States Patent [19]

Wassenhoven

[11] Patent Number: 6,047,538

[45] Date of Patent: Apr. 11, 2000

[54] FIBER GUIDE CONDUIT FOR AN OPEN-END SPINNING DEVICE

[75] Inventor: Heinz-Georg Wassenhoven, Mönchengladbach, Germany

[73] Assignee: W. Schlafhorst AG & Co., Moenchengladbach, Germany

[21] Appl. No.: 09/366,119

[22] Filed: Aug. 2, 1999

[30] Foreign Application Priority Data

Aug. 10, 1998 [DE] Germany ..... 198 36 066

[51] Int. Cl.[7] ..... D01H 4/00

[52] U.S. Cl. ..... 57/413; 57/406; 57/407; 57/411

[58] Field of Search ..... 57/406, 407, 411, 57/413

[56] References Cited

U.S. PATENT DOCUMENTS 5,111,651 5/1992 Pohn et al. ..... 57/413
5,682,137 10/1997 Raasch ..... 57/407
5,901,546 5/1999 Lovas et al. ..... 57/413
5,953,897 9/1999 Wassenhoven et al. ..... 57/411

FOREIGN PATENT DOCUMENTS 39 15 813 A1 11/1990 Germany .
92 18 361 U 4/1994 Germany .

*Primary Examiner*—William Stryjewski
*Attorney, Agent, or Firm*—Kennedy Covington Lobdell & Hickman, LLP

[57] ABSTRACT

An open-end spinning device (1) with a spinning rotor (3) whose spinning cup rotates at a high speed in a rotor housing (2) loaded by a vacuum and closed by a yarn guide plate. A fiber guide conduit (14), arranged between a sliver opening device (26) and the spinning cup, has a wall section with an elevated coefficient of friction comprised of conduit sections (29, 30) of different surface roughnesses. The wall of the entrance-side section (29) of the fiber guide conduit has a distinctly greater surface roughness ($R_z$) than the wall of the exit-side section (30) of the fiber guide conduit.

11 Claims, 2 Drawing Sheets

FIBER GUIDE CONDUIT FOR AN OPEN-END SPINNING DEVICE

BACKGROUND OF THE INVENTION

The present invention relates generally to an open-end (OE) spinning device and, more particularly, to a fiber guide conduit for such a spinning device having a wall surface with an elevated coefficient of friction.

Open-end spinning devices with a fiber guide conduit designed in such manner are described, e.g., in German Utility Model DE-GM 92 18 361.

As is known, during open-end spinning a sliver stored in spinning cans is separated by a so-called opening cylinder into its individual fibers and the latter are fed pneumatically via a fiber guide conduit onto the sliding surface of a spinning rotor rotating at a high speed in a rotor housing.

The yarn qualities which can be achieved also depend, among other things, on how many of the individual fibers are drawn into alignment with one another while they are being fed onto the sliding surface of the spinning rotor and how many of these fibers pass in relative alignment into the rotor groove. The fiber guide conduit of such OE spinning devices is therefore customarily constructed in such a manner that during the fiber transport an acceleration of the flow of transport air takes place, which results in a drawing or elongation of the individual fibers floating in the air flow.

However, both the rate at which the individual fibers enter into the fiber guide conduit as well as the maximum exit rate at which the individual fibers should leave the fiber guide conduit are very largely preset in open-end spinning devices by certain physical structural conditions of such spinning devices and/or by necessities of spinning technology.

The entering rate of the individual fibers into the fiber guide conduit results, e.g., from the circumferential speed of the opening-cylinder fittings. This rotational speed should not drop below a certain value, in the interest of good fiber individualization and of a sufficient cleaning of the feed sliver. If the rotational speeds of the opening-cylinder fittings are too high, however, there is the danger that fiber damage will occur or that undesired separations of so-called material fibers will occur in the area of the soil exit opening.

The maximum exit rate of the individual fibers out of the fiber guide conduit is limited by the rotational speed of the point where the fiber strikes the sliding surface of the spinning rotor. In order to avoid that individual fibers are compressed or buckled when striking a sliding surface which is running rather slowly, it must be assured that the feed rate of the individual fibers is at least not above the rotational speed of their striking point on the sliding surface of the spinning rotor.

In German Utility Model DE-GM 92 18 361 the individual fibers slide over a type of fiber braking surface before they are fed onto the sliding surface of the spinning rotor. That is, this known open-end spinning device comprises a fiber guide conduit whose mouth area has been roughened by sandblasting so that a braking surface is provided for the individual fibers exiting from the fiber guide conduit. This fiber braking surface is intended to cause the individual fibers exiting from the fiber guide conduit, which first pass with their leading end into the effective range of an air flow circulating with the spinning rotor and are subjected thereby to an acceleration, to be mechanically delayed at the same time at their trailing end by the braking surface and elongated as a result.

However, practical experiments have shown that such a sandblast-roughened braking surface does not lead to the improved fiber values hoped for in the area of the mouth of the fiber guide conduit, but on the contrary presents a number of problems.

Specifically, in some instances, individual fibers can remain hanging on the roughened braking surface, where they soon form fiber bundles which result in yarn errors and/or yarn breaks during the following separation. Moreover, a part of the individual fibers first strike the braking surface with their leading end. These fibers then tumble over as a rule and are fed in a totally undefined disposition onto the sliding surface of the spinning rotor.

SUMMARY OF THE INVENTION

In view of known open-end spinning devices of the above described type, it is an object of the present invention to improve such open-end spinning devices, especially their fiber guide conduit.

The present invention solves this problem by providing an open-end spinning device basically having a rotor housing, a vacuum source for application to the rotor housing, a spinning rotor having a spinning cup for rotation at a high speed in the rotor housing, a yarn guide plate for selectively closing and opening the rotor housing, a sliver opening device for separating a sliver into individual fibers for spinning, and a fiber guide conduit arranged between the sliver opening device and the spinning cup, the fiber guide conduit having a wall surface with an elevated coefficient of friction. According to the present invention, the wall surface of the fiber guide conduit has a fiber entrance section and a fiber exit section, the fiber entrance section being of a relatively greater surface roughness than the fiber exit section with the surface roughness of each of the fiber entrance and exit sections (i.e. the peak-to-valley height of the surface undulations which effect the roughened character of the surface) being less than the average diameter of the individual fibers being spun (which may typically be approximately 10 $\mu$m).

The design of the fiber guide conduit in accordance with the invention has the advantage that the individual fibers still have a stretched alignment to a very great extent when leaving the fiber guide conduit, on the one hand, and the exit rate of these fibers is sufficiently far below the rotational speed of their striking point on the sliding surface of the spinning rotor, on the other hand. That is, the individual fibers separated by the opening cylinder are at first accelerated clearly less in the section of the fiber guide conduit at its entrance end on account of the relatively high surface roughness of the conduit wall in such section of the guide conduit than the fiber acceleration which typically occurs in conventional fiber guide conduits and the fibers are even braked somewhat on the relatively rough conduit wall. Individual fibers which are not completely stretched or become somewhat compressed in the more roughened entrance section of the fiber guide conduit are subsequently elongated and aligned as desired in the less roughened exit section of the fiber guide conduit, since the transport air in this conduit area is sufficiently accelerated on account of the design of the fiber guide conduit.

On the whole, in the case of a fiber guide conduit designed in accordance with the present invention, the exit rate of the fibers drops distinctly compared to a conventionally designed fiber guide conduit, i.e., an increase of the relative speed between the fibers to be fed and the rotating sliding surface of the spinning rotor develops. This increase of the relative speed results on the whole in an improved stretching of the fibers of the fed fibers and therewith to better yarn values.

In a preferred embodiment, the surface roughness of the conduit wall of the fiber entrance section of the fiber guide conduit is greater than about 4 μm, preferably 4 to 6 μm. The surface roughness is thus distinctly below the typical diameter of a cotton fiber (about 10 μm), so that on the one hand accumulations of fiber on the conduit wall can be reliably avoided and on the other hand such surface roughness results in a reduced acceleration of the fibers in this section of the fiber guide conduit and therewith in a reduction of the transport speed of the individual fibers.

In a preferred embodiment, the fiber entrance section of the fiber guide conduit may be a component of a separate guide conduit insert which can be fixed, as is known, in a corresponding bore or recess of the opening-cylinder housing of the sliver opening device. Thus, the conduit section of the fiber guide conduit formed by the insert can be surface treated specially without any problems to provide the conduit wall of the insert with the desired differential surface roughness. For example, the guide-conduit insert can be coated in a dispersion bath, such as preferably a nickel dispersion bath to deposit a nickel dispersion layer on the guide-conduit insert, in which bath may be provided grains of a desirably hard material such that grains of the hard material become embedded in the dispersion layer on the guide-conduit insert to impart thereto the desired surface roughness. These grains of hard material can be, e.g., diamond bodies or grains of an industrial ceramic material such as silicon carbide.

The fiber exit section of the fiber guide conduit has a surface roughness below 4 μm, preferably 2 to 3 μm. The relatively strong acceleration of the flow of transport air which takes place in this conduit section on account of the design of the conduit section, as well as of the very smooth conduit wall, results subsequently in a stretching of the individual fibers. The transport speed of the individual fibers remains distinctly below the transport speed in traditional fiber guide conduits and sufficiently below the rotational speed of the fiber striking point of the fibers on the sliding surface of the spinning rotor.

The difference in speed given by the reduction of the transport speed of the individual fibers between fibers and striking point has the result that all individual fibers which are accelerated when striking the sliding surface of the spinning rotor and even fibers which previously exhibited no elongated state are stretched. This improvement of the elongated state of the individual fibers becomes noticeable in a positive manner subsequently in the spun yarn by improved yarn values, especially by a greater tear or breaking resistance.

In an advantageous development of the invention, the middle longitudinal axes of the two entrance and exit sections of the fiber guide conduit are arranged at an angle to one another. This design feature also has the result that the individual fibers are braked somewhat at first before their entrance into the fiber exit section of the fiber guide conduit and as a consequence have a lower exit speed, compared to traditional fiber guide conduits, when exiting out of the fiber exit section of the fiber guide conduit.

In a preferred embodiment, the fiber exit section of the fiber guide conduit is a component of a replaceable conduit-plate adapter. Such a design has the advantage that the surface roughness of the fiber exit conduit section can be varied as needed without any problems. In order to provide the fiber exit section of the fiber guide conduit with another surface roughness, the conduit-plate adapter in use can be readily replaced by a conduit-plate adapter with the desired surface roughness.

Further details, features and advantages of the present invention will be understood from an exemplary embodiment described in the following specification with reference to the accompanying drawings.

DETAILED DESCRIPTION OF THE PREFERRED EMBODIMENT

Figure 1:
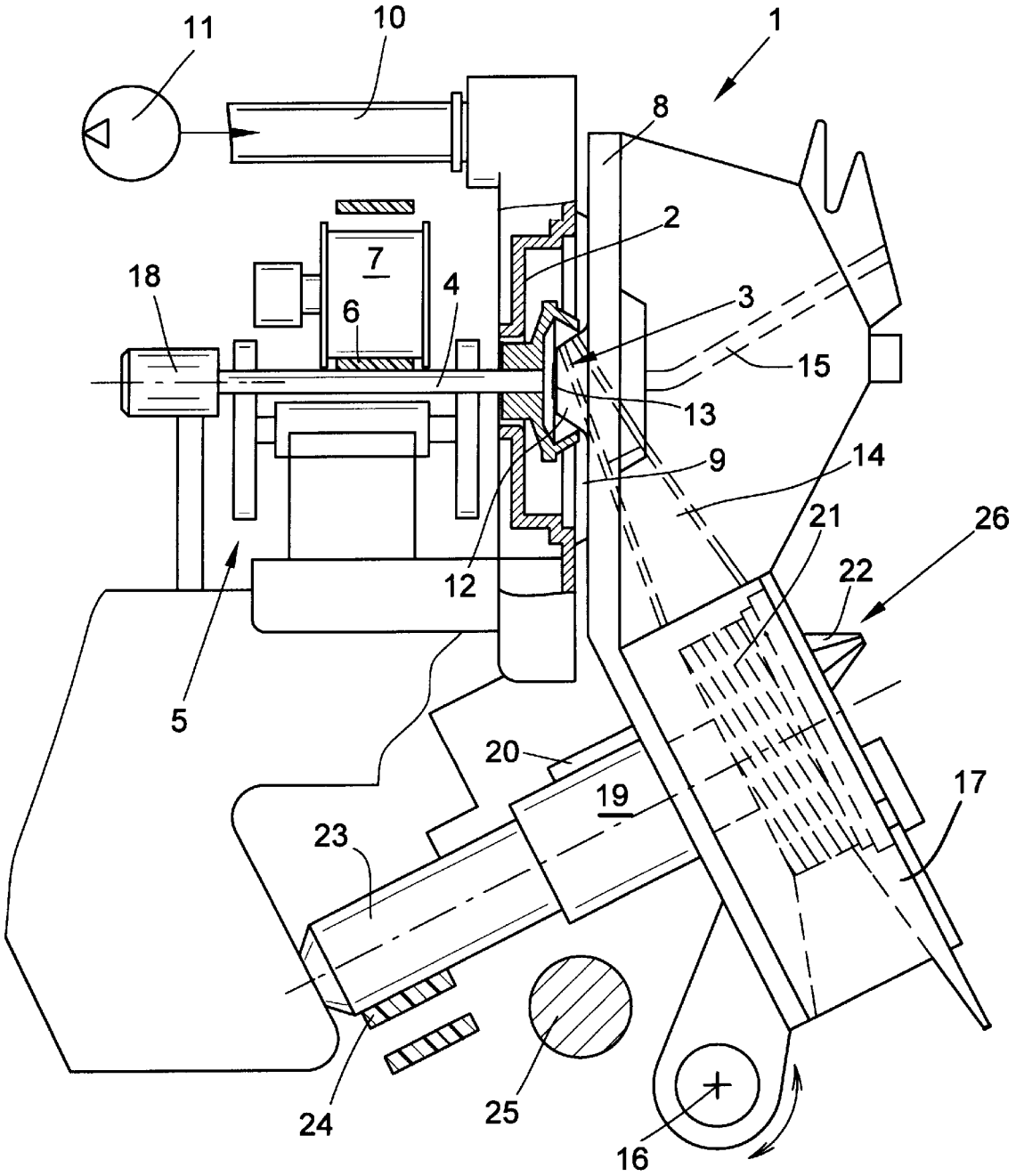
FIG. 1 is a side elevational view, partially in vertical cross-section, of an open-end spinning device with a fiber guide conduit having entrance and exit conduit sections of different surface roughnesses in accordance with the present invention.

Referring now to the accompanying drawings and initially to FIG. 1, an open-end spinning device is designated in its entirety by reference numeral 1. As is known, the spinning device has a rotor housing 2 in which the spinning cup of a spinning rotor 3 rotates at a high speed. Spinning rotor 3 is supported with its rotor shaft 4 in the bearing nip of support-disk bearing 5 and is driven by tangential belt 6 which runs the length of the machine and is maintained in driving engagement with the shaft 4 by pressure roller 7. Rotor shaft 4 is fixed axially, e.g., via permanent-magnet thrust bearing 18.

As is customary, rotor housing 2 is open to the front side of the spinning device and is closed during spinning operation by pivotably mounted cover element 8 equipped with a conduit plate (not shown in detail) into which seal 9 is fitted. Moreover, rotor housing 2 is connected via suction line 10 to vacuum source 11 which produces the vacuum necessary in rotor housing 2 for the spinning process.

Replaceable conduit-plate adapter 12 is arranged in cover element 8 or in the conduit plate, which adapter 12 comprises yarn draw-off jet 13 as well as the mouth area of fiber guide conduit 14. Yarn draw-off jet 13 is followed by yarn draw-off tube 15. In addition, opening-cylinder housing 17 is fastened on cover element 8, which is mounted so that it can pivot in a limited manner about pivot axis 16. Cover element 8 also comprises bearing brackets 19, 20 for supporting opening cylinder 21 and sliver feeding cylinder 22. Opening cylinder is driven in the area of its whorl 23 by traveling tangential belt 24 extending the length of the machine, whereas the sliver feeding cylinder 22 is preferably driven via worm gear arrangement (not shown) connected to drive shaft 25 extending the length of the machine.

Figure 2:
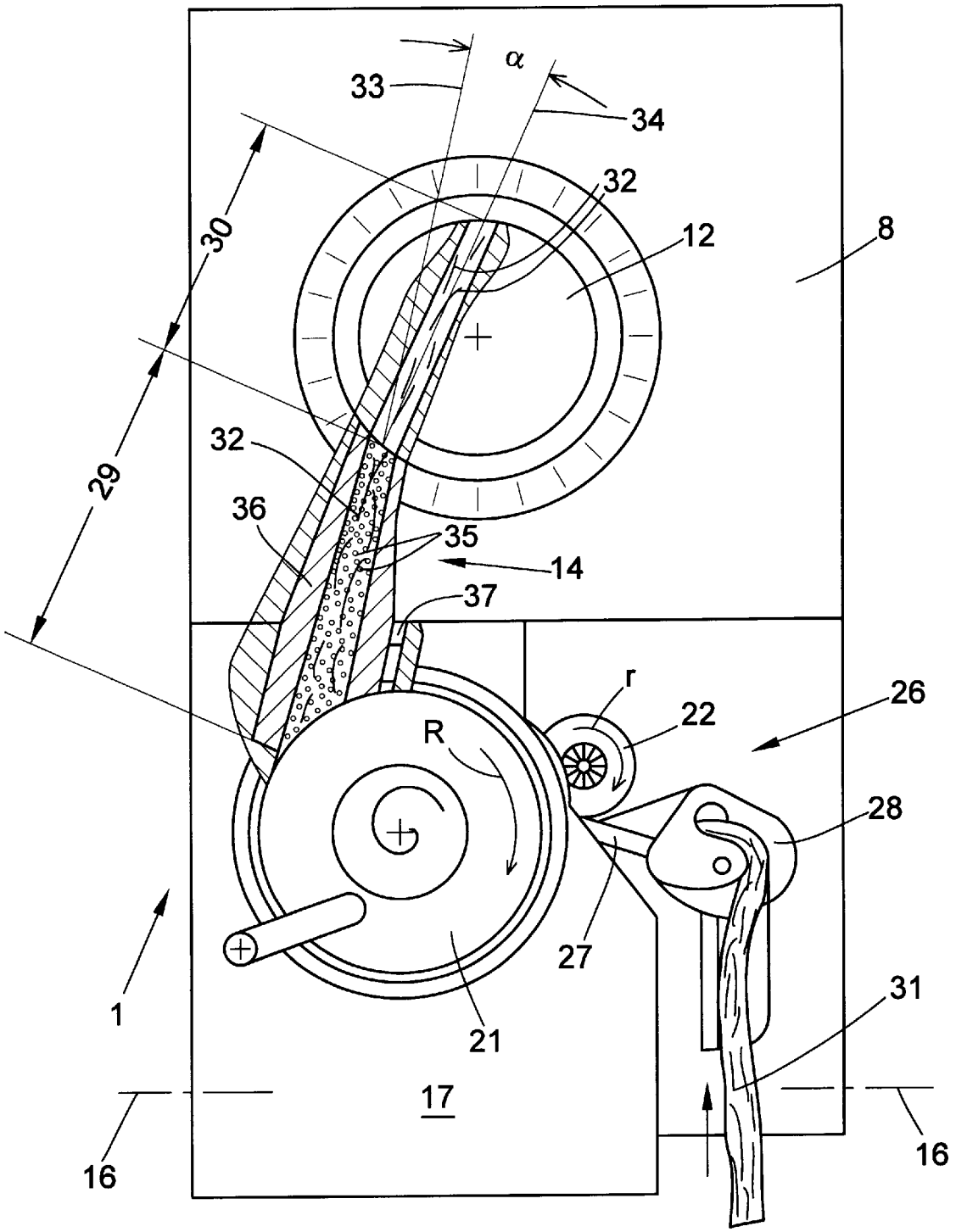
FIG. 2 is a front elevational view, also in partial vertical section, of the cover element of the open-end spinning device according to FIG. 1, equipped with the fiber guide conduit of the present invention.

FIG. 2 shows a front view of cover element 8 of open-end spinning device 1. The area of fiber guide conduit 14 is shown in section. As can be seen, fiber guide conduit 14 consists of section 29 of the fiber guide conduit at its entrance end and section 30 of the fiber guide conduit at its exit end. Fiber entrance section 29 of the fiber guide conduit is a component, in the exemplary embodiment shown, of a separate conduit insert 36 fitted into an appropriate receptacle or holding fixture 37 of opening-cylinder housing 17. Fiber exit section 30 of the fiber guide conduit is a component of conduit-plate adapter 12, which is fixed in a replaceable manner in an appropriate recess of the conduit plate (not shown in more detail) which is screwed onto cover element 8.

According to the present invention, the wall surface of conduit section 29 at the entrance end of the fiber guide conduit has a greater surface roughness than the wall of conduit section 30 at the exit end of the fiber guide conduit. The heightened surface roughness $R_t$ of conduit section 29 on the entrance side preferably results from the embedding of grains of hard material 35 in a surface coating on the wall of such section, e.g. a nickel dispersion layer. Suitable grains 35 of hard material are, e.g., diamond grains, silicon carbide grains or the like.

The respective surface roughnesses $R_t$ of sections 29, 30 of the fiber guide conduit, preferably 4 to 6 $\mu$m in the case of conduit section 29 and preferably 2 to 3 $\mu$m in the case of conduit section 30, is distinctly below the typical diameter of the individual cotton fibers 32 to be transported in fiber guide conduit 14, generally in the range of approximately 10 $\mu$m.

The operation of the device of the present invention may thus be understood. A sliver 31 stored in a spinning can (not shown) is introduced via sliver compressor 28 into sliver opening device 26. Specifically, sliver 31 is clamped between feed trough 27 and sliver draw-in cylinder 22 and, by the action of sliver draw-in cylinder 22 rotating slowly in direction r, is fed to opening cylinder 21 rotating at a relatively high speed in direction R. Sliver 31 is thereby progressively separated into its individual fibers 32 by peripheral tooth-like fittings on the opening cylinder and the fibers are in turn accelerated by the fittings of the opening cylinder to their rotational speed.

Individualized fibers 32 are released from the opening cylinder under the influence of the prevailing centrifugal forces as well as the vacuum present in the entrance area of fiber guide conduit 14, and the fibers then enter with approximately the peripheral speed of the opening-cylinder into entrance-end conduit section 29 of fiber guide conduit 14. However, on account of the relatively great surface roughness ($R_t$>4 $\mu$m) of the conduit wall in fiber entrance section 29, the acceleration of the fibers, obligatorily taking place on account of the nozzle-like design of the fiber guide conduit 14 and also necessary for the elongation of the individual fibers, remains within acceptable limits. That is, the greater surface roughness of the conduit wall in conduit section 29 has the result that the traveling speed of individual fibers 32 in this conduit section is distinctly below the traveling speed which the individual fibers would have in a conduit section without the greater surface roughness provided by the present invention.

Conduit section 29 is followed, preferably at an angle $\alpha$, by conduit section 30, whose wall surface has a distinctly lesser surface roughness ($R_t$<4 $\mu$m). Individual fibers 32, whose traveling speed is somewhat reduced in the area of the angular transition of the two conduit sections 29, 30, are subsequently accelerated within exit-end conduit section 30 with the flow of transport air on account of the very smooth conduit wall ($R_t$ 2 to 3 $\mu$m) as well as of the conically tapering cross section of the conduit, whereby the fibers receive a very extensive stretched alignment.

Since the speed at which individual fibers 32 leave fiber guide conduit 14 is distinctly below the rotational speed of their striking point on the sliding surface of the spinning rotor, the fibers striking at first the more rapid sliding surface of the spinning rotor with their leading fiber end are further accelerated by the spinning rotor. Even such individual fibers which were previously not yet fully elongated are thereby drawn into a stretched state and slide in this state into the rotor groove, where they are spun with other fibers to the yarn end being drawn off.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. An open-end spinning device comprising a rotor housing, a vacuum source for application to the rotor housing, a spinning rotor having a spinning cup for rotation at a high speed in the rotor housing, a yarn guide plate for selectively closing and opening the rotor housing, a sliver opening device for separating a sliver into individual fibers for spinning, a fiber guide conduit arranged between the sliver opening device and the spinning cup, the fiber guide conduit having a wall surface with an elevated coefficient of friction, the wall surface having a fiber entrance section and a fiber exit section, the fiber entrance section being of a relatively greater surface roughness than the fiber exit section, the surface roughness of each of the fiber entrance and exit sections being less than the average diameter of the individual fibers being spun.

2. The open-end spinning device in accordance with claim 1, characterized in that the fiber entrance section of the fiber guide conduit has a surface roughness of greater than about 4 $\mu$m.

3. The open-end spinning device in accordance with claim 2, characterized in that the fiber entrance section of the fiber guide conduit has a surface roughness of about 4 $\mu$m to 6 $\mu$m.

4. The open-end spinning device in accordance with claim 1, characterized in that the fiber entrance section of the fiber guide conduit has a nickel dispersion layer with embedded grains of a hard material.

5. The open-end spinning device in accordance with claim 4, characterized in that the embedded grains of a hard material comprise diamond grains.

6. The open-end spinning device in accordance with claim 4, characterized in that the embedded grains of a hard material comprise silicon carbide.

7. The open-end spinning device in accordance with claim 1, characterized in that the fiber guide conduit comprises a fiber guide conduit element fixed in a bore of the sliver opening device and the fiber entrance section of the fiber guide conduit is arranged in the fiber guide conduit element.

8. The open-end spinning device in accordance with claim 1, characterized in that the fiber exit section of the fiber guide conduit has a surface roughness of less than about 4 $\mu$m.

9. The open-end spinning device in accordance with claim 1, characterized in that the fiber exit section of the fiber guide conduit has a surface roughness of about 2 $\mu$m to 3 $\mu$m.

10. The open-end spinning device in accordance with claim 1, characterized in that of the fiber exit section of the fiber guide conduit has a central longitudinal axis and the fiber entrance section of the fiber guide conduit has a central longitudinal axis, the central longitudinal axis of the fiber exit section being inclined at an angle relative to the central longitudinal axis of the fiber entrance section.

11. The open-end spinning device in accordance with claim 1, characterized by a replaceably arranged conduit-plate adapter, the fiber exit section of the fiber guide conduit being a component of the conduit-plate adapter.

* * * * *